US007360768B2

(12) United States Patent
Watanabe et al.

(10) Patent No.: US 7,360,768 B2
(45) Date of Patent: Apr. 22, 2008

(54) INTAKE GASKET

(75) Inventors: Katsumi Watanabe, Yokohama (JP); Yuichi Hayashi, Yokohama (JP)

(73) Assignee: Nichias Corporation, Tokyo (JP)

( * ) Notice: Subject to any disclaimer, the term of this patent is extended or adjusted under 35 U.S.C. 154(b) by 0 days.

(21) Appl. No.: 11/473,165

(22) Filed: Jun. 23, 2006

(65) Prior Publication Data

US 2007/0001405 A1 Jan. 4, 2007

(30) Foreign Application Priority Data

Jul. 4, 2005 (JP) ..... 2005-194700

(51) Int. Cl.
*F02F 11/00* (2006.01)

(52) U.S. Cl. ..... 277/592

(58) Field of Classification Search ..... 277/591–596, 277/654

See application file for complete search history.

(56) References Cited

U.S. PATENT DOCUMENTS 4,468,044 A * 8/1984 Ulmer et al. ..... 277/596
4,728,110 A * 3/1988 Nakasone ..... 277/595
4,807,892 A * 2/1989 Udagawa ..... 277/595
4,979,758 A * 12/1990 Miyaoh ..... 277/595
5,041,466 A * 8/1991 Takahashi et al. ..... 521/91
5,087,058 A * 2/1992 Miura et al. ..... 277/595
5,277,434 A * 1/1994 Kestly et al. ..... 277/592
5,360,219 A * 11/1994 Okuda et al. ..... 277/592
5,511,796 A * 4/1996 Udagawa ..... 277/593
5,551,709 A * 9/1996 Plunkett ..... 277/592
5,642,893 A * 7/1997 Udagawa ..... 277/592
6,182,976 B1 * 2/2001 Maekawa et al. ..... 277/593
6,299,175 B1 * 10/2001 Maekawa et al. ..... 277/593
6,386,549 B1 * 5/2002 Johnson ..... 277/592
6,409,178 B1 * 6/2002 Raden et al. ..... 277/592
6,422,572 B1 * 7/2002 Ueda et al. ..... 277/591
6,565,099 B1 * 5/2003 Ottinger et al. ..... 277/608
6,923,450 B2 * 8/2005 Unseld et al. ..... 277/592
7,000,925 B2 * 2/2006 Stapel et al. ..... 277/593
7,074,357 B2 * 7/2006 Senda et al. ..... 264/259
7,097,177 B2 * 8/2006 Kasuya ..... 277/592
2002/0074737 A1 * 6/2002 Isogai ..... 277/592
2004/0012155 A1 * 1/2004 Diez ..... 277/593

FOREIGN PATENT DOCUMENTS

JP 6-300139 10/1994

* cited by examiner

*Primary Examiner*—Patricia Engle
*Assistant Examiner*—Gilbert Lee
(74) *Attorney, Agent, or Firm*—Oblon, Spivak, McClelland, Maier & Neustadt, P.C.

(57) ABSTRACT

An intake gasket to be inserted between a cylinder head and a manifold, comprising an intermediate rib member with a three-layer structure formed from a central thin metal plate and rubber layers provided on first and second sides of the central thin metal plate, first and second metal plates disposed on first and second sides of the intermediate rib member, and elastic metal substrates disposed on both sides of the metal plates, the intermediate rib member comprising a first rib formed around the periphery thereof and a second rib formed around the periphery of a fluid passage hole, wherein a space is formed by the rib of the intermediate rib member and the metal plates.

10 Claims, 2 Drawing Sheets

INTAKE GASKET

BACKGROUND OF THE INVENTION

1. Field of the Invention

The present invention relates to an intake gasket to be inserted between a cylinder head and a manifold so as to inhibit a temperature increase in an intake manifold.

2. Background Art

A gasket for the manifold of the intake air converging section (intake manifold) in conventional engines is a laminated body of metal plates having a bead formed around the periphery of intake holes (such a gasket being herein referred to as "intake gasket"). The intake gasket is placed between a cylinder head and a manifold. Heat of the cylinder head is transmitted to the manifold via the gasket, thereby increasing the temperature of the manifold. As a result, the temperature of the manifold increases close to the temperature of the cylinder head.

The intake-air temperature must be reduced for increasing the engine output. Because the intake air is sent to the cylinder head via the manifold, the temperature of the manifold itself must be reduced to decrease the temperature of the intake air.

JP-A-06-300139 discloses an intake-exhaust gasket installed on a flange of a cylinder head having counter flow-type intake holes and exhaust holes aligned in the same direction, wherein the intake side is provided with a thin metal plate with an elastic layer coated thereon on both sides of an intermediate plate (claim 1, FIG. 2). This intake-exhaust gasket is effective for both the intake holes and the exhaust holes at the same time, exhibits superior sealing performance, and can be easily installed.

The intake-exhaust gasket described in JP-A-6-300139 has an elastic layer formed of a fiber-reinforced synthetic rubber or synthetic resin of which the coefficient of thermal conductivity is smaller than that of the laminated layer of metal plates. The thickness of the elastic layer, however, is in a range of 50-300 μm, which is insufficient for decreasing the temperature of the manifold itself.

An object of the present invention is, therefore, to provide an intake gasket that can shut out heat from the cylinder head so as to make transmission of heat to the manifold difficult.

In view of the prior art, the inventors of the present invention have conducted extensive studies. As a result, the inventors have found that in an intake gasket comprising an intermediate rib member with a three-layer structure formed from a thin metal plate and rubber layers provided on both sides of the thin metal plate, metal plates disposed on both sides of the intermediate rib member, and elastic metal substrates disposed on both sides of the metal plates, in which the intermediate rib member comprises a first rib formed around the periphery thereof and a second rib around the periphery of a fluid passage hole, if a space is formed from the rib of the intermediate rib member and the metal plates disposed on both sides of the intermediate rib member, the air layer in that space can shut out heat from the cylinder head so as to make transmission of heat to the manifold difficult. This finding has led to the completion of the present invention.

SUMMARY OF THE INVENTION

Specifically, the present invention provides an intake gasket to be inserted between a cylinder head and a manifold, comprising an intermediate rib member with a three-layer structure formed from a thin metal plate and rubber layers provided on both sides of the thin metal plate, metal plates disposed on both sides of the intermediate rib member, and elastic metal substrates disposed on both sides of the metal plates, the intermediate rib member comprising a first rib formed around the periphery thereof and a second rib around the periphery of a fluid flowing hole, wherein a space is formed from the rib of the intermediate rib member and the metal plates disposed on both sides of the intermediate rib member.

In the intake gasket of the present invention, a space is formed from the rib of the intermediate rib member and the metal plates disposed on both sides of the intermediate rib member, and air is accumulated in that space. The coefficient of thermal conductivity of the air at a standard atmospheric pressure is 0.1-0.01 W/mK, which is smaller by two digits or more as compared with the coefficient of thermal conductivity of iron and stainless steel of 10-100 W/mK. For this reason, the air layer entrapped in the space between the metal plates can shut out heat from the cylinder head and make transmission of heat to the manifold difficult, whereby the gasket can reduce the intake air temperature as compared with conventional gaskets.

DETAILED DESCRIPTION OF THE INVENTION AND PREFERRED EMBODIMENTS

Figure 1:
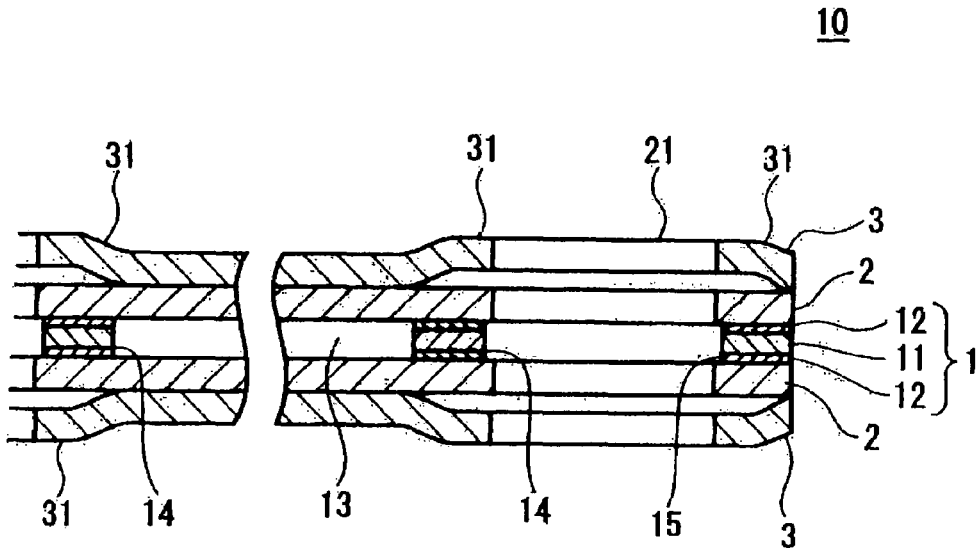
FIG. 1 is a cross-sectional view of a part of the intake gasket according to an embodiment of this example.
Figure 2:
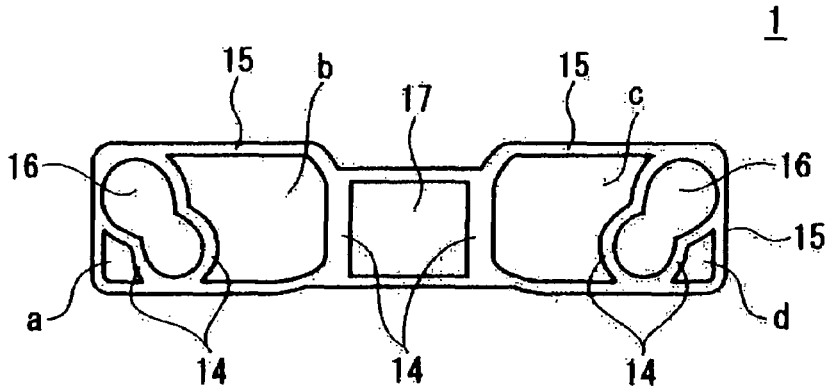
FIG. 2 is a plan view of an intermediate rib member forming the intake gasket of FIG. 1.
Figure 3:
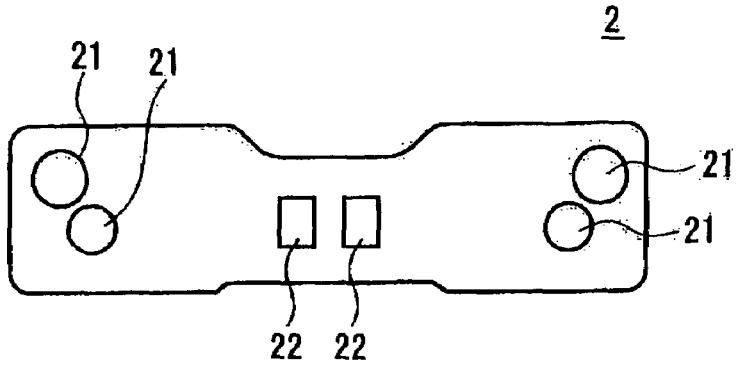
FIG. 3 is a plan view of a metal plate forming the intake gasket of FIG. 1.
Figure 4:
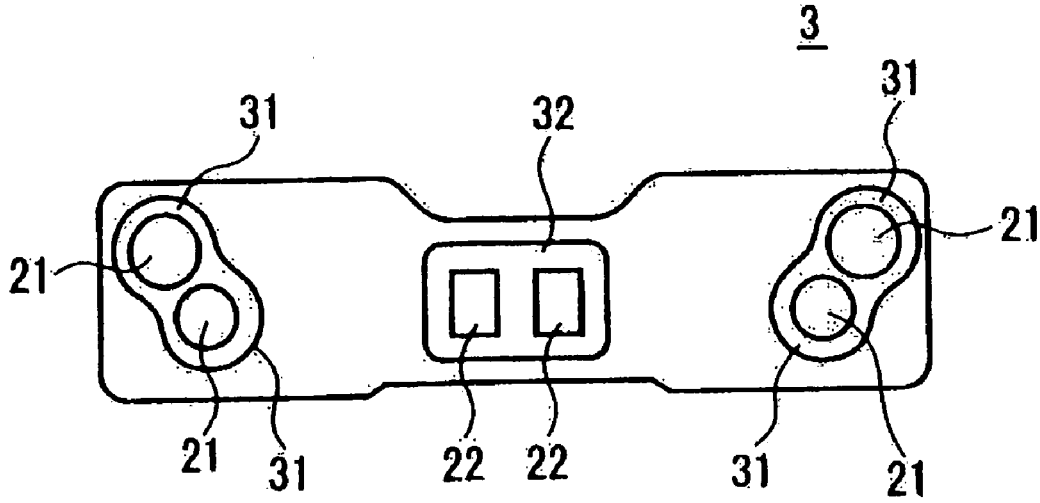
FIG. 4 is a plan view of an elastic metal substrate forming the intake gasket of FIG. 1.

An intake gasket according to an embodiment of the present invention will be explained with reference to FIGS. 1-4. FIG. 1 is a cross-sectional view of a part of the intake gasket of this embodiment, FIG. 2 is a plan view of an intermediate rib member forming the intake gasket of FIG. 1, FIG. 3 is a plan view of a metal plate forming the intake gasket of FIG. 1, and FIG. 4 is a plan view of an elastic metal substrate forming the intake gasket of FIG. 1. Small through-holes such as bolt holes are omitted from FIGS. 2-4.

Intake gasket 10 is inserted between a cylinder head and a manifold and comprises an intermediate rib member 1 with a three-layer structure formed from a thin metal plate 11 and rubber layers 12 and 12 provided on both sides of the thin metal plate 11, metal plates 2 and 2 disposed on both sides of the intermediate rib member 1, and elastic metal substrates 3 and 3 disposed on both sides of the metal plates 2 and 2, wherein a space 13 is formed from the rib of the intermediate rib member 1 and the metal plates 2 and 2 disposed on both sides of the intermediate rib member 1.

The metal plates 2 and 2 disposed on both sides of the intermediate rib member 1 respectively form a top plate and a bottom plate of the space 13 and, at the same time, have a function of increasing sealing performance in cooperation with a bead 31 of the elastic metal substrates 3. Although there are no specific limitations, the material of the metal plates 2 and 2 is usually iron or stainless steel with a thickness of 0.2-2.0 mm, and preferably 0.4-1.0 mm. If the metal plates 2 and 2 are too thin, rigidity is insufficient for maintaining a prescribed thickness of the space 13; if too thick, a problem of a weight increase occurs. Air passage holes 21 and 22 in which the air supplied from the manifold flows, bolt inserting holes, not shown in the drawings, and the like are formed in the metal plates 2 and 2. There are no specific limitations to the positions and shapes of these holes.

Although there are no specific limitations, the material of the elastic metal substrates 3 and 3 disposed on both sides of the metal plate 2 is usually iron or stainless steel with a thickness of 0.2-0.8 mm. If the metal plates 2 and 2 are too thin, the repulsive force of the beads by tightening bolts declines, resulting in impaired sealing performance; if too thick, a problem of a weight increase occurs. In the same manner, air passage holes 21 and 22, bolt inserting holes, not shown in the drawings, and the like are formed in the elastic metal substrates 3 and 3. In addition, beads 31 and 32 with similar figures as the fluid passage holes are formed on the periphery of the fluid passage holes of the elastic metal substrates 3 and 3. In this manner, a function of sealing the area surrounding the periphery of the fluid passage holes is provided by the repulsive force of the beads produced by tightening the bolts. One or more additional elastic metal substrates 3 and 3 with the same configuration may be provided on both sides.

Although there are no specific limitations, iron or stainless steel can be given as the material of the thin metal plate 11 used in the intermediate rib member 1. The thickness of the thin metal plate 11 is 0.1-2.0 mm, and preferably 0.2-1.0 mm. If the thickness of the thin metal plate 11 is too small, the thickness of the space 13 is too small to provide a desired heat rejection effect. According to the model analysis of a laminated structure in which a metal plate is used on both sides of an air layer, the air thickness of 0.3 mm or more is required for achieving a 100 $W/m^2K$ or less heat transmission rate at which a heat rejection effect (insulation effect) is exhibited. If the thickness of the thin metal plate 11 is too large, a problem of a weight increase occurs.

There are no specific limitations to rubber layers 12 and 12 formed on both sides of the thin metal plate 11. A non-foamed rubber layer or a foamed rubber layer can be given as examples, with the foamed rubber layer being preferable for decreasing the thermal conductivity. As examples of the non-foamed rubber layer, known NBR, HNBR, fluororubber, EPDM, acrylic rubber, and the like conventionally used for a gasket with rubber layers laminated thereon can be given, with NBR, HNBR, and fluororubber being preferable.

As the method for forming a foamed rubber layer, for example, a method of applying a rubber composition containing a thermal decomposition-type foaming agent to both sides of the thin metal plate 11 to a predetermined thickness and heating the applied composition to cause the foaming agent to foam, thereby forming a foamed rubber layer can be given. Although there are no specific limitations, a foaming agent with a foaming temperature of 120° C. or higher, and particularly from 150 to 210° C., is preferably used as the thermal decomposition-type foaming agent. The amount of the foaming agent is preferably 20-60 wt %, and particularly preferably 15-35 wt % of the rubber composition. As specific thermal decomposition-type foaming agents, thermal decomposition-type azodicarbonamides and microcapsule-type vinylidene chloride-acrylonitrile copolymers can be given.

As examples of the rubber incorporated into the rubber composition, NBR, HNBR, fluororubber, EPDM, acrylic rubber, and the like having a Mooney viscosity of 10-70 can be given, with NBR, HNBR, and fluororubber being preferable. The amount of the rubber is preferably 20-70 wt % of the rubber composition in the case of a rubber having a Mooney viscosity of 10-70, and 20-60 wt % in the case of a rubber having a Mooney viscosity of 20-60. Deterioration of the foamed rubber layer can be effectively inhibited by incorporating these rubbers. When NBR is used, NBR with an AN value of 39-52 is preferable for providing the rubber composition with oil resistance.

A vulcanizing agent and a vulcanization accelerator are usually added to the rubber composition. It is preferable to add a large amount of a vulcanizing agent to increase the vulcanizing density. In the case of sulfur, an amount of 1.5-4.5 phr is preferably used. A vulcanization accelerating agent with high performance which reaches T50 in four minutes in Curelastometer testing (150° C.) is preferably used.

The rubber composition is dissolved in an organic solvent, for example, an aromatic hydrocarbon solvent such as toluene, an ester solvent, or the like, to prepare a coating liquid. The solid component concentration of the rubber composition in the organic solvent is usually 10-60 wt %.

The heating conditions for foaming the rubber composition are usually at 150-240° C. for 5-15 minutes. The vulcanizing agent, vulcanization accelerator, and foaming agent are selected and the heating conditions such as heating temperature and heating time are appropriately controlled so that a foamed rubber layer having a foaming magnification of 2-4 times and having 80% or more continuous foams can be produced. The thickness of the rubber layer formed on both sides of the thin metal plate is preferably 30-200 μm per side. If the thickness of the rubber layer is too small, not only the sealing performance between the laminated layers decreases, but also a desired insulating effect cannot be obtained due to heat transfer through a first rib and a second rib. If the thickness of the rubber layer is too great, the rubber layer easily deteriorates. Forming a foamed rubber layer with the above-described thickness on both sides of the thin metal plate ensures outstanding sealing performance between the rubber layers and the metal plates provided on both outside surfaces of the rubber layers even under high temperature and high pressure conditions, without deterioration.

The intermediate rib member 1 has at least a first rib 15 formed on the outer periphery and a second rib 14 formed on the periphery of the fluid passage holes 21 and 22, and may further have a third rib (not shown) which connects the first rib 15 and the second rib 14. The first rib 15 and the second rib 14 are indispensable for sealing. A space 13 with a stable volume and configuration can be arbitrarily formed by the third rib. The second rib 14 of the intermediate rib member 1 has a configuration approximately conforming to the configuration of the bead 31 formed in the elastic metal substrates 3 and 3. The second rib 14 of the intermediate rib member 1 is located opposing the bead 31 formed in the elastic metal substrates 3 and 3 in the direction to which the fluid flows and is wide enough to cover the bead 31 widthwise. Using this configuration, if the intermediate rib member 1, metal plate 2, and elastic metal substrate 3 are laminated and clamped, the intermediate rib member 1 (rib) functions as a pillar and an air space 13 (an air layer) is formed between two sheets of metal plates on which no rib is present. In the intermediate rib member 1 in FIG. 2, symbols a to d indicate the space 13 formed from the intermediate rib member 1 and two sheets of metal plates. When the intermediate rib member 1 is extracted as a single member as shown in FIG. 2, the symbols a to d appear as through-holes. The air space 13 can only be formed when the metal plates 2 and 2 are disposed on both sides of the intermediate rib member 1. Symbols 16 and 17 are fluid passage holes of the intermediate rib member 1.

Although there are no specific limitations to the number of air spaces formed from the first rib 15 and the second rib 14, from the first rib 15 and the third rib, etc., 2 to 14 air spaces are preferable and 4 to 10 air spaces are particularly preferable for forming a stable air space structure without reducing the volume of air spaces. The area of the air spaces occupying the intermediate rib member 1 is about 20% or more, and preferably 30-70%, although the specific figure varies according to the size of the intermediate rib member 1. The thickness of the air space 13 (air layer), which is approximately the same as the thickness of the intermediate rib member 1, is preferably 0.2 mm or more, and particularly preferably 0.3-1.0 mm. If the thickness of the air layer is 0.2 mm or more, the heat transmission rate between the metal plates on both sides of the air layer can be reduced to 100 $W/m^2K$ or less, by which the heat rejection effect is remarkably increased. In addition, because the volume between the metal plates on both sides of the rib other than the air layer is smaller in percentage than the air layer, and the coefficient of thermal conductivity of the rubber layers provided on both sides of the thin metal plate 11 of the intermediate rib member 1 is small as compared with that of the metal, a superior heat rejection effect can be obtained as compared with the case of directly attaching metal plates without such rubber layers. The intermediate rib member 1 with a three-layer structure is usually prepared by cutting a sheet-like three layer structural body in a prescribed configuration as shown in FIG. 2, for example.

The intake gasket of the present invention is usually fabricated by laminating the intermediate rib member 1, metal plate 2, and elastic metal substrate into one structural body by clamping the laminate. This structural body is placed between a cylinder head and a manifold and clamped with bolts. The intake gasket is used on the intake manifold side of a cross-flow type manifold in which an intake manifold and an exhaust manifold are located on the opposing sides of the engine. It can also be applied to a gasket structure of the intake side of intake-exhaust gaskets installed on a flange of a cylinder head equipped with a counter flow type intake and exhaust holes in the same direction. In this instance, a member for linking the intake side with the exhaust side may be either the intermediate rib member 1 or the thin metal plate 11 forming the intermediate rib member 1.

EXAMPLES

The present invention will be described in more detail by examples, which should not be construed as limiting the present invention.

Example 1

The following intermediate rib member, metal plate, and elastic metal substrate were prepared. The intermediate rib member was sandwiched between the two metal plates. This intermediate rib member sandwiched between the two metal plates was further sandwiched between the two elastic metal substrates. The entire object was clamped to obtain an integral laminated body A. Using the resulting laminated body, the temperature difference between the cylinder head and intake manifold was measured by the method described below. As a result, when the thickness of the air layer was 0.4 mm, the temperature difference between the cylinder head and intake manifold was 13° C.

(Preparation of Intermediate Rib Member)

A foamed rubber layer with a thickness of 200 μm was applied to both sides of a steel plate (SPCC) with a thickness of 0.2 mm by the method described below, and cut into a formed object corresponding to that shown in FIG. 2.

(Method for Forming Foamed Rubber Layer)

A rubber composition consisting of 50 wt % of NBR with a Mooney value of 50, 25 wt % of heat decomposition type azodicarbonamide, and 25 wt % of vulcanizing agent and vulcanization accelerator was dissolved in a mixed organic solvent of toluene and ethyl acetate to a solid component concentration of 40 wt % to obtain a coating solution. The coating solution was applied onto a stainless steel plate treated with a primer using a roll coater to a thickness of 35 μm. The coating was treated with heat at 210° C. for 10 minutes to obtain an intermediate rib member having a foamed rubber layer on both sides.

(Metal Plate)

Two stainless steel plates (SUS 430) with a thickness of 0.4 mm were cut into formed objects corresponding to that shown in FIG. 1.

(Elastic Metal Substrate)

A solid rubber layer with a thickness of 50 μm was formed on both sides of a stainless steel plate (SUS 301H) with a thickness of 0.2 mm. The stainless steel plate was subjected to a bending work and cutting work to form an object corresponding to that shown in FIG. 4.

(Measurement of Temperature Difference)

An intake gasket (sample) was inserted between the cylinder head and intake manifold of an actual engine model for temperature measurement. The temperature of the intake manifold when the cylinder head was heated was measured to calculate the temperature difference between the intake manifold and the cylinder head.

Example 2

An intermediate rib member was obtained according to the same method as in Example 1, except that the foamed rubber layer with a thickness of 200 μm was formed on both sides of a steel plate (SPCC) with a thickness of 1.0 mm by the method described below and an air layer with a thickness of 1.2 mm was provided. A laminated body B was prepared in the same manner as in Example 1, except for using this intermediate rib member. As a result, when the thickness of the air layer was 1.2 mm, the temperature difference between the cylinder head and intake manifold was 16° C.

Comparative Example 1

A solid rubber layer with a thickness of 50 μm was formed on both sides of a stainless steel plate (SUS 301H) with a thickness of 0.2 mm. The stainless steel plate was subjected to a bending work and cutting work to form an elastic metal substrate corresponding to that shown in FIG. 4. The two elastic metal substrates were laminated to obtain a laminated body C. The temperature difference between the cylinder head and intake manifold was 9° C.

EXPLANATION OF SYMBOLS

1: intermediate rib member
2: metal plate
3: elastic metal substrate
10: intake gasket
11: thin metal plate
12: rubber layer
13, *a-d*: space (air layer)
14: second rib
15: first rib
21, 22: air passage hole
31: bead area

What is claimed is:

1. An intake gasket to be inserted between a cylinder head and a manifold, comprising:

an intermediate rib member with a three-layer structure formed from a central thin metal plate and first and second rubber layers provided on first and second sides of the thin metal plate, respectively;

first and second metal plates disposed on first and second sides of the intermediate rib member; and first and second elastic metal substrates disposed on an outer side of the first metal plate and an outer side of the second metal plate, respectively, the intermediate rib member including a first rib formed around the periphery thereof and a second rib around the periphery of a fluid passage hole, wherein a closed space is formed from the first rib and the second rib of the intermediate rib member and the first and second metal plates, such that the first rib and second rib bound the closed space in first and second directions, respectively, and the first and second metal plates bound the closed space in third and fourth directions, respectively.

2. The intake gasket according to claim 1, wherein the space has a thickness of 0.3-5.0 mm.

3. The intake gasket according to claim 1, wherein the rubber layers formed on both sides of the intermediate rib member are foamed rubber layers.

4. The intake gasket according to claim 1, wherein the elastic metal substrates have a bead formed around the periphery of the fluid passage hole.

5. The intake gasket according to claim 4, wherein the second rib formed around the periphery of the fluid passage hole of the intermediate rib member and the bead formed around the periphery of the fluid passage hole are located opposite each other in the direction in which the fluid flows.

6. The intake gasket according to claim 1, wherein the rubber is vulcanized rubber.

7. The intake gasket according to claim 1, wherein the first and second rubber layers are from 30-200 μm thick.

8. The intake gasket according to claim 1, wherein the first and second elastic metal substrates define first and second outermost surfaces of the intake gasket.

9. The intake gasket according to claim 1, wherein the first rubber layer is in direct contact with the central thin metal plate and the first metal plate, the first metal plate is in direct contact with the first elastic substrate, and the first elastic substrate is an exterior layer of the intake gasket configured to seal against a cylinder head.

10. The intake gasket according to claim 9, wherein the second rubber layer is in direct contact with the central thin metal plate and the second metal plate, the second metal plate is in direct contact with the second elastic substrate, and the second elastic substrate is an exterior layer of the intake gasket configured to seal against a manifold.

* * * * *